United States Patent [19]

Wallin et al.

[11] Patent Number: 4,714,025

[45] Date of Patent: Dec. 22, 1987

[54] ARRANGEMENT FOR A SWITCHBOARD DESK

[76] Inventors: Per Olov T. Wallin; Bengt H. Warell; Ake P. Svensson, all of Televerket, S-123 86 Farsta; Kurt A. Lundström, Televerket Industridivisionen, Svedjer. 12 S-931 36 Skellefteå ; Lars A. Johansson, KamomillgåAngen 25, 611 45 Nyköping, all of Sweden

[21] Appl. No.: 803,760

[22] PCT Filed: Mar. 12, 1985

[86] PCT No.: PCT/SE85/00110

§ 371 Date: Nov. 18, 1985

§ 102(e) Date: Nov. 18, 1985

[87] PCT Pub. No.: WO85/04083

PCT Pub. Date: Sep. 26, 1985

[30] Foreign Application Priority Data

Mar. 16, 1984 [SE] Sweden ..... 8401479

[51] Int. Cl.[4] ..... A47B 85/00

[52] U.S. Cl. ..... 108/20; 340/870.38; 108/147

[58] Field of Search ..... 297/330; 108/144, 147, 108/20; 318/490; 340/870.38

[56] References Cited

U.S. PATENT DOCUMENTS

| | | | |
|---|---|---|---|
| 1,590,296 | 6/1926 | Klein et al. | 108/20 |
| 3,080,204 | 3/1963 | Lindhgren | 108/20 X |
| 3,080,835 | 3/1963 | Guglielmi | 108/147 X |
| 3,203,670 | 8/1965 | Farris | 108/20 X |
| 3,961,317 | 6/1976 | De Brem et al. | 340/870.38 X |
| 4,247,816 | 1/1981 | Harrer et al. | 340/870.38 X |
| 4,290,065 | 9/1981 | Gleason | 340/870.38 X |
| 4,381,507 | 4/1983 | Parmer | 340/870.38 |
| 4,392,375 | 7/1983 | Eguchi et al. | 340/870.38 X |
| 4,516,805 | 5/1985 | Leeper et al. | 297/330 |

*Primary Examiner*—Peter A. Aschenbrenner

*Attorney, Agent, or Firm*—Pollock, Vande Sande & Priddy

[57] ABSTRACT

A switchboard desk is equipped with a height-adjustable desk-top and at least two telescopic legs. The desk comprises devices which effect the raising and lowering of the top, and control devices. The height-adjustable devices comprise at least two hydraulic cylinders each positioned in a telescopic leg and connected to a hydraulic pump, which in turn is driven by an electric motor. The controlling devices comprise manually actuated devices which switch on the electric motor to rotate in either direction according to the way they are actuated. A potentiometer monitors the rotation of the electric motor and controls a digital voltmeter for providing the indication of the position of the desk-top above a reference level.

7 Claims, 7 Drawing Figures

ARRANGEMENT FOR A SWITCHBOARD DESK

TECHNICAL FIELD

The present invention relates to an arrangement for a switchboard desk with a height adjustable desk top. The height adjustable desk top is equipped with two or more telescopic legs. The arrangement comprises a device which effects the raising and lowering of the desk top and devices to control the effective devices.

It is already known to make desks with a desk-top and a leg framework such that the desk-top can be raised and lowered in conjunction with manual influencing devices. It is also known to provide electric motors in the respective telescopic legs of a desk which can be raised and lowered, to effect the raising and lowering of the desk-top. The electric motors are controlled by electrical circuits. Code plate devices are provided on the telescopic legs for monitoring the actual position of the desk-top and in addition indicating devices are provided to enable the desk-top height to be read off from the upper side.

DESCRIPTION OF THE INVENTION

THE TECHNICAL PROBLEM

There is an overall aim with this kind of desk to obtain a technically simple and yet satisfactorily functioning design for the various parts of the desk. One requirement in this connection is for a minimum of components in the control and effective devices. To provide, for example, electric motors on at least two of the telescopic legs of the desk complicates the construction and is relatively expensive at the same time.

SUMMARY OF THE INVENTION

The main object of the present invention is to propose an arrangement which solves the above-mentioned problems. It can be considered essentially characteristic of the new arrangement that the effective devices comprise at least two hydraulic cylinders each positioned in its respective telescopic leg and connected to at least one hydraulic pump which can be driven by an electric motor. It is a further characteristic of the the present invention that the controlling devices comprise manually actuated devices which switch on the electric motor to rotate in either direction according to the way they are actuated, and that a device monitoring the rotation of the electric motor actuates indicating devices which show the position of the desk-top above a reference level which may be formed by the floor on which the desk is set up.

Further embodiments of the present invention relate to more detailed information on how the various parts of the apparatus. Thus, in a preferred embodiment the devices monitoring the rotation of the electric motor consist of potentiometer devices which supply voltage to a digital volt-meter, the outputs of which are connected or may be connected to the indicating devices. The potentiometer devices here can comprise at least one potentiometer which is incorporated in a voltage divider, the central outlet of the potentiometer being connected for voltage supply to the digital voltmeter.

The electric motor is controlled by means of the manual influencing devices which control according to their actuation the voltage supply to relay devices or corresponding devices. The relay devices or corresponding devices connect power supply to the electric motor.

In the first embodiment of the invention a first relay is employed for actuating the motor in a first direction of rotation, which may correspond to a downward movement of the desk-top. In a corresponding manner, a second relay connects the current to actuate the electric motor in a second direction of rotation, which thus corresponds to upward movement of the desk-top.

The apparatus is provided with limits switches for obtaining a maximum and minimum position of the desk-top above the reference level, which means that the desk top may be operated only over a predetermined distance.

In a preferred embodiment of the invention the devices which monitor the rotation of the electric motor are designed so that a variation brought about by one of these devices of approximately 1 mV in a supply voltage output corresponds to a raising or lowering of the desk-top by approximately 1.0 mm. The potentiometer may also be made to rotate through approximately 15° for each variation of 1 mm registered by the indicating devices.

The manual influencing devices for raising and lowering the desk-top are further preferably designed so that simultaneous actuation of the control devices cuts the supply to the electric motor and keeps it cut off.

The present invention provides for an apparatus with relatively few components and technically simple construction. Moreover, considerable resolution in the indication of the height of the desk-top is made possible.

Furthermore, the proposed apparatus can be made very insensitive to changes in the voltage supply. The indication is also exceptionally insensitive to variations in the voltage supply.

Considerable advantages are also afforded by the invention which provides a simple, inexpensive and operationally reliable functioning of a desk which can be raised and lowered. The system is exceptionally insensitive to disturbance, and with the proposed construction only one electric motor is required, compared with previous proposals where there is an electic motor for each telescopic leg.

A presently proposed embodiment of an arrangement with the characteristics which are significant to the invention is described below with reference to the accompanying drawings, on which

DESCRIPTION OF THE PREFERRED EMBODIMENTS

Figure 1:
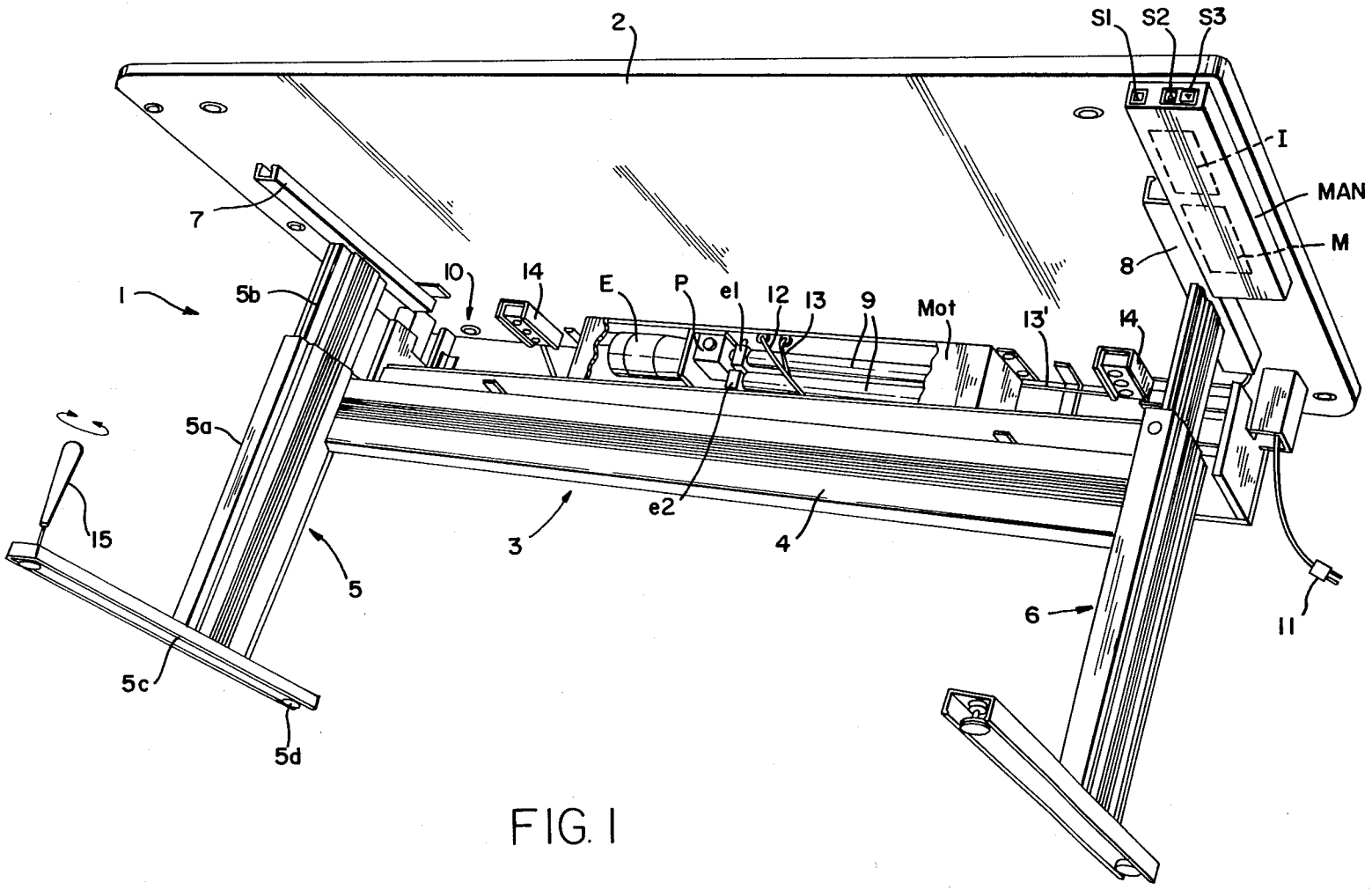
FIG. 1 is a perspective view looking at an angle from below and to the right, showing the construction of a desk incorporating the invention.

In FIG. 1 a desk, which may consist of a switchboard desk, is designated 1. The desk is formed by a desk-top 2 and a framework 3 which comprises a cross-bar 4, to the ends of which two telescopic legs 5 and 6 are connected. The respective telescopic legs comprise an outer part 5*a* and an inner part 5*b*. Towards the bottom the outer part 5*a* is provided with a base part 5*c* which extends in the depth direction of the desk. The base parts are equipped with adjustable feet 5*d* which are intended to co-act with a foundation on which the desk can be set up. The desk-top 2 is fixed to the inner parts 5*b* of the telescopic legs.

The inner parts of the telescopic legs can be influenced by means of a hydraulic cylinder arranged in the legs and not shown in FIG. 1. The hydraulic cylinders can be arranged in the telescopic legs in a manner which is known so that mutual displacement by means of the hydraulic cylinders can be effected by the leg parts 5*a* and 5*b*, and thus the raising and lowering of the desk-top.

Underneath the desk-top two bars 7 and 8 are provided to which the inner legs parts 5*b* are connected. The hydraulic cylinders in the telescopic legs are supplied in a known way by at least one pump 9, for example a double pump of a known kind, which is positioned in a motor housing Mot on the lower face of the desk-top. The motor housing is positioned directly underneath the desk-top and substantially in the central region thereof. The desk is also provided with a cable duct 10 and connecting devices 11 for connecting an external electrical supply, for example for connecting to the conventional main power supply. The device 11 here is preferably a plug which can be used in an electrical socket in the normal electricity main supply circuit.

In addition to the pump 9 the motor housing contains an electric motor E which drives the hydraulic pump 9 through an output shaft. The hydraulic pump is in communication with the hydraulic cylinders in the telescopic legs through hydraulic pipelines 12 and 13. On the output shaft E' of the electric motor a potentiometer P and two limit switches e1 and e2 are provided. An electrical cable to enable power to be taken of under the desk at 14 is designated 13'. The potentiometer is acted upon by the shaft via a helical thread and is of the ten-revolution type.

On the underside of the desk-top 2, towards the back and directly out to the right-hand side a control box MAN is arranged. Manual actuating devices S1, S2 and S3 are provided at the rear end of the control box. In the central box there are two cards which are described below and are designated I and M.

The base parts 5*c* of the telescopic legs are made with the same profile as the bars 7 and 8, but the base parts 5*c* are made longer. The bar profile is of the type which has an open, substantially rectangular or square cross-section, the open part of the profile being directed downwardly in the case of the base part 5*c* and upwardly in the case of the bars 7. In the arrangement shown the height-adjustment devices 5*d* are accessible from above with a screw-driver, hexagonal key or the like, which considerably facilitates the horizontal adjustment of the desk. The control box MAN also contains indicating devices which are visible from the upper side of the desk, which is not shown in FIG. 1.

Figure 2:
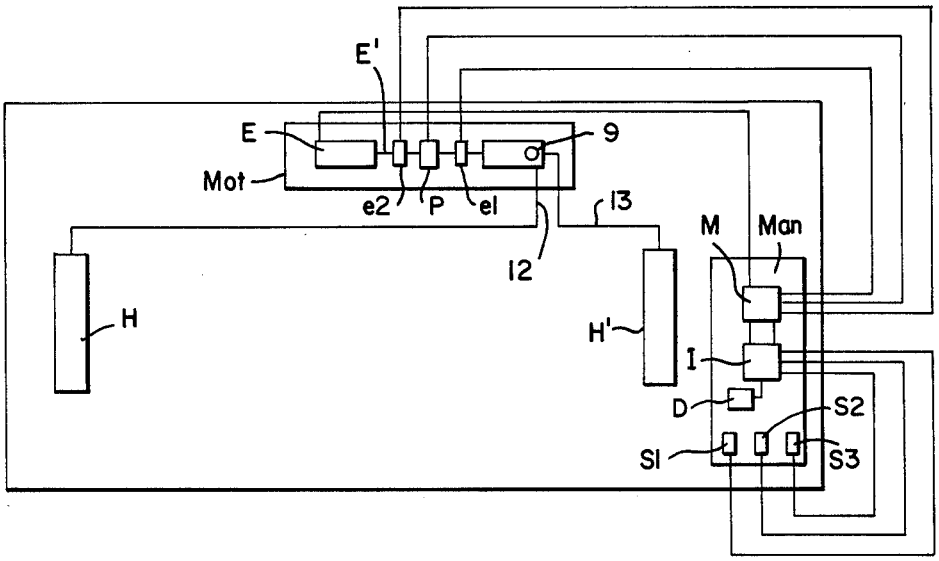
FIG. 2 is a basic diagram showing the position of various components in the desk shown in FIG. 1.

In FIG. 2 the devices which effect the raising and lowering of the desk-top are shown in a basic diagram, together with the devices which control these devices. Moreover, the hydraulic cylinders arranged in the legs of the desk are indicated by H and H'. The hydraulic pump 9 and the cylinders are of a known type which are available on the open market. The raising and lowering devices may be regarded as comprising the hydraulic system 9, H, H' and the electric motor. The controlling devices comprises the equipment assembled in the control box MAN and the monitoring devices P, e1 and e2. Display units are indicated by the letter D in FIG. 2. With regard to the manual actuating devices, S1 is a control device for switching a 220 V main supply on and off. The manual actuating device S2 is used for maneuvering the desk upwardly and the device S3 for maneuvering the desk downwardly. The actuating devices S1, S2 and S3 can be of a kind which is known.

The electric motor E drives the hydraulic pump in a manner which is known and the potentiometer P applied to the transmission between the electric motor and the pump monitors the rotation of the electric motor. The potentiometer again can be of a kind which is known and can be arranged in a known manner. The same applies to the limit switches e1 and e2 provided on the transmission between the motor and the pump.

Figure 3:
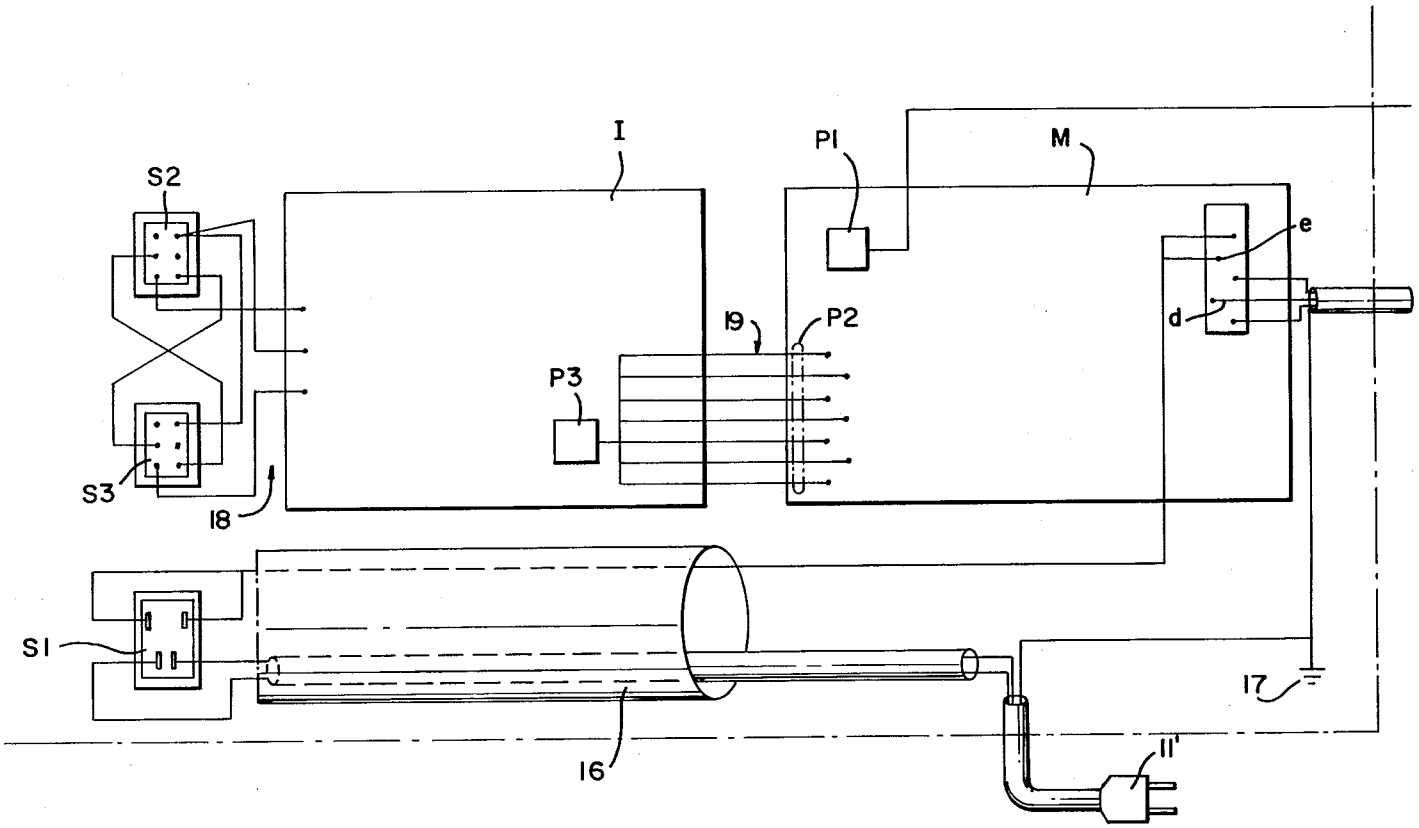
FIG. 3 is a block diagram of a control box comprised in the apparatus.

The construction of the control box MAN is shown in more detail in FIG. 3. In the box there is an indication card I and a control card M. In addition, the earthed plug 11' for connecting the equipment to a 220 V, 50 Hz electrical supply is also comprised therein. The positioning of the switch S1 is shown, as is connection of the manual actuating devices S2, S3. The various parts are connected by leads in a manner which is known. The lead to the switch S1 is inserted in a shrink-fitted sheath 16. An earth screw is indicated by 17. The leads are provided with stress-relieving devices in a known way. The leads between S2, S3 and the indicating card are shown schematically by 18 and the leads between the indicating card and the control card by 19. In FIG. 3 contact breakers P1 and P2 are also shown, and as far as these contact breakers are concerned reference is made to FIG. 5 described below.

Figure 4:
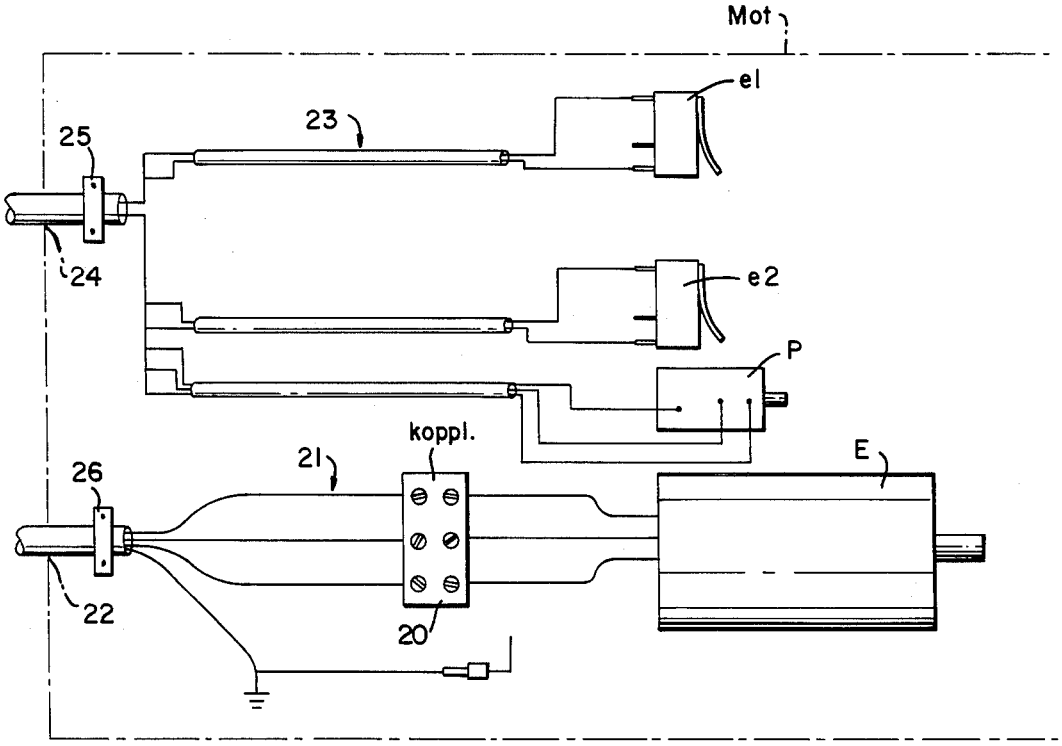
FIG. 4 is a block diagram of a motor housing appertaining to the apparatus.

The parts contained in the motor housing Mot are shown in FIG. 4. The electric motor E is of the ORIENTAL BKEA 60101 type, which consists of a single-phase non-synchronous motor (see also FIG. 7). A junction box to which the electric motor connections are made is designated 20. The supply is effected via the lead 21 which is introduced via a through-bore 22 in the box. The physical positioning of the potentiometer P and the limit switches e1 and e2 is also known. The connecting leads 23 are introduced via a through-bore 24. Conventional stress-relieving devices 25 and 26 relieve the loading of outer forces on the leads. The limit switch e1 defines the highest position of the desk-top above the reference level, while the limit switch e2 defines the lowest position above the reference level.

Figure 5:
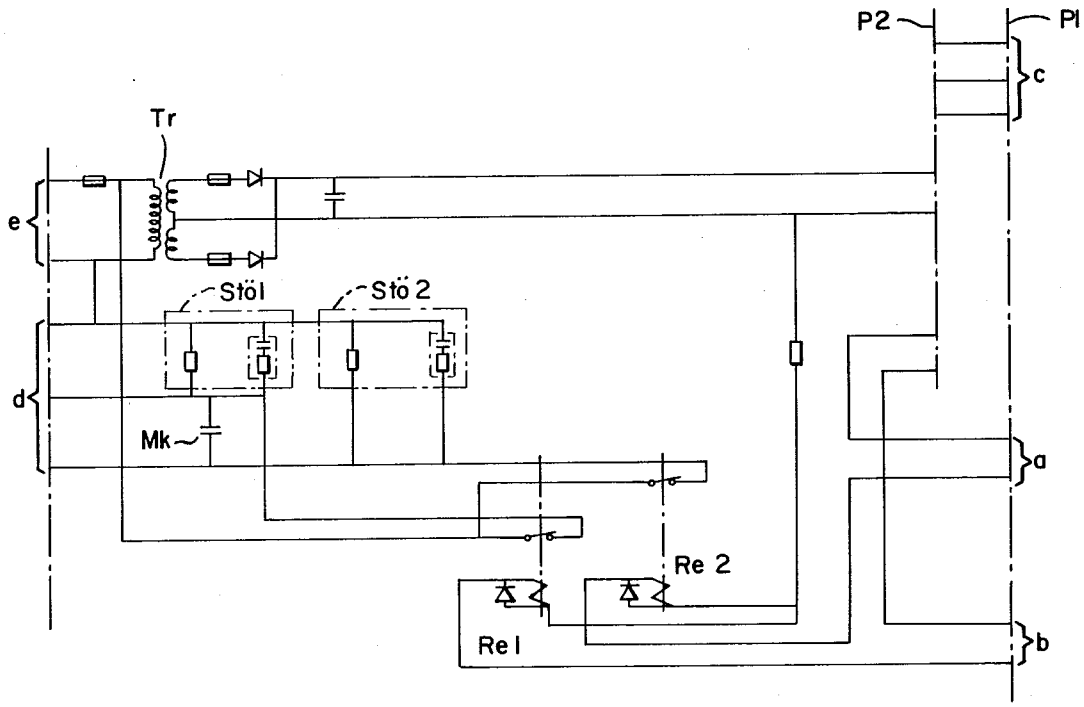
FIG. 5 is a basic diagram of the construction of a control card.

FIG. 5 shows the control card which in this case comprises the connections a and b to the limit switches, the connection c to the potentiometer, the connection d to the electric motor, and the connection e to the power supply. The connections a, b and c are located in the connecting device P1. The connecting device P2 is provided for connecting the control card. There is also a power transformer Tr, two relays Re1 and Re2, and two anti-interference units St81 and St82. A condenser MK appertaining to an electric motor is also arranged on the control card.

Figure 6:
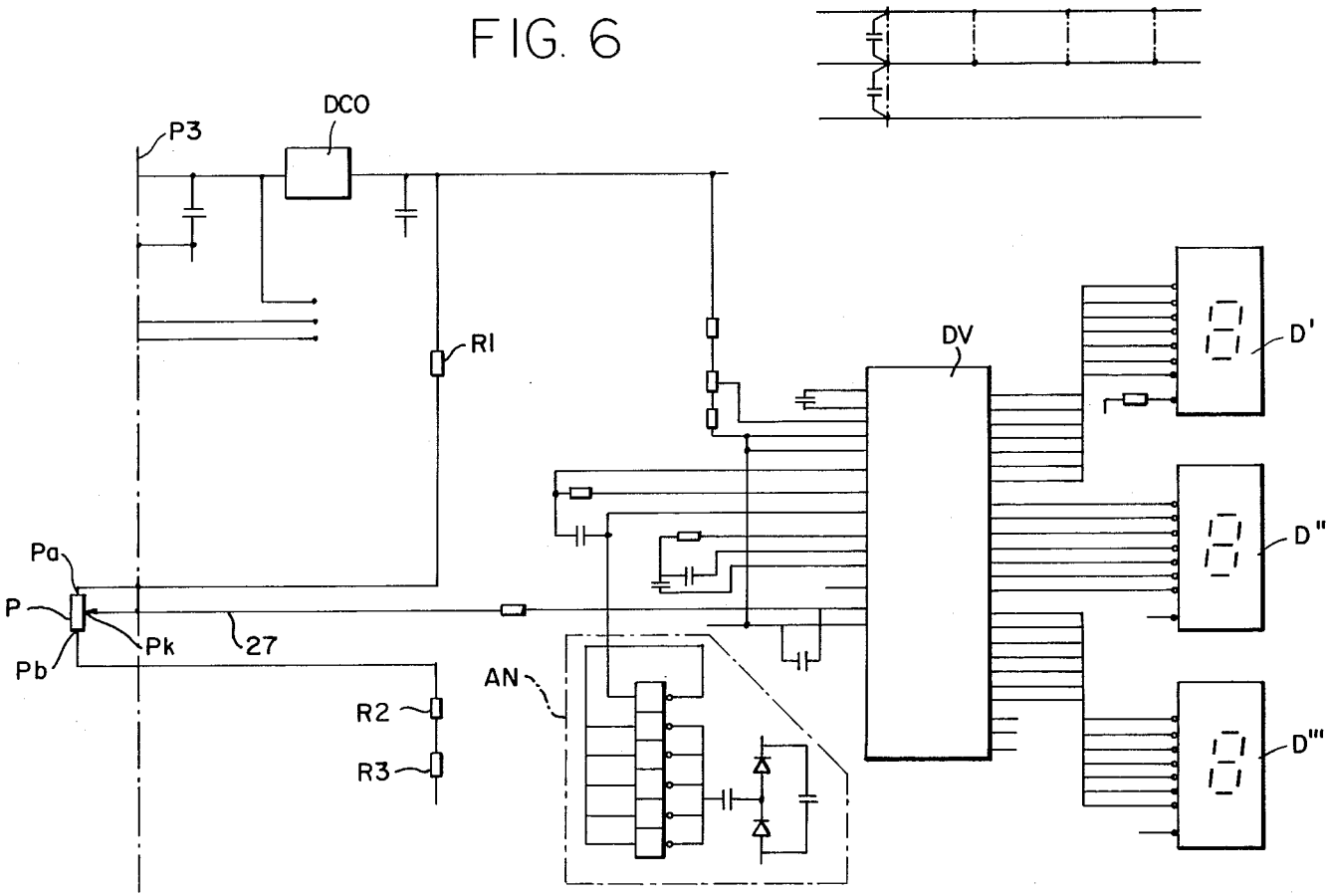
FIG. 6 is a basic diagram of the construction of an indication card.

FIG. 6 shows the indication card I which bears a digital voltmeter DV with integral operating circuits for the display unit which comprises the three elements D', D'' and D'''. Furthermore, there is a DC transformer which is designated DCO. The potentiometer P (see FIG. 4) appertains to a voltage divider with resistances R1, R2 and R3. The connections Pa and Pb are connected respectively to the resistance R1 and R2 which in turn is series-connected to the resistance R3. The resistance R1 is connected to the output of the DC transformer. The central output Pk on the potentiometer is connected to the digital voltmeter via the lead 27. A voltage transforming circuit AN applies a negative voltage to the digital voltmeter DV. The equipment is connected via a contact device P3 to the above-mentioned contact device P2 on the manipulation card. The equipment shown in FIGS. 5 and 6 can consist of components which are known and they are therefore not described in more detail.

Figure 7:
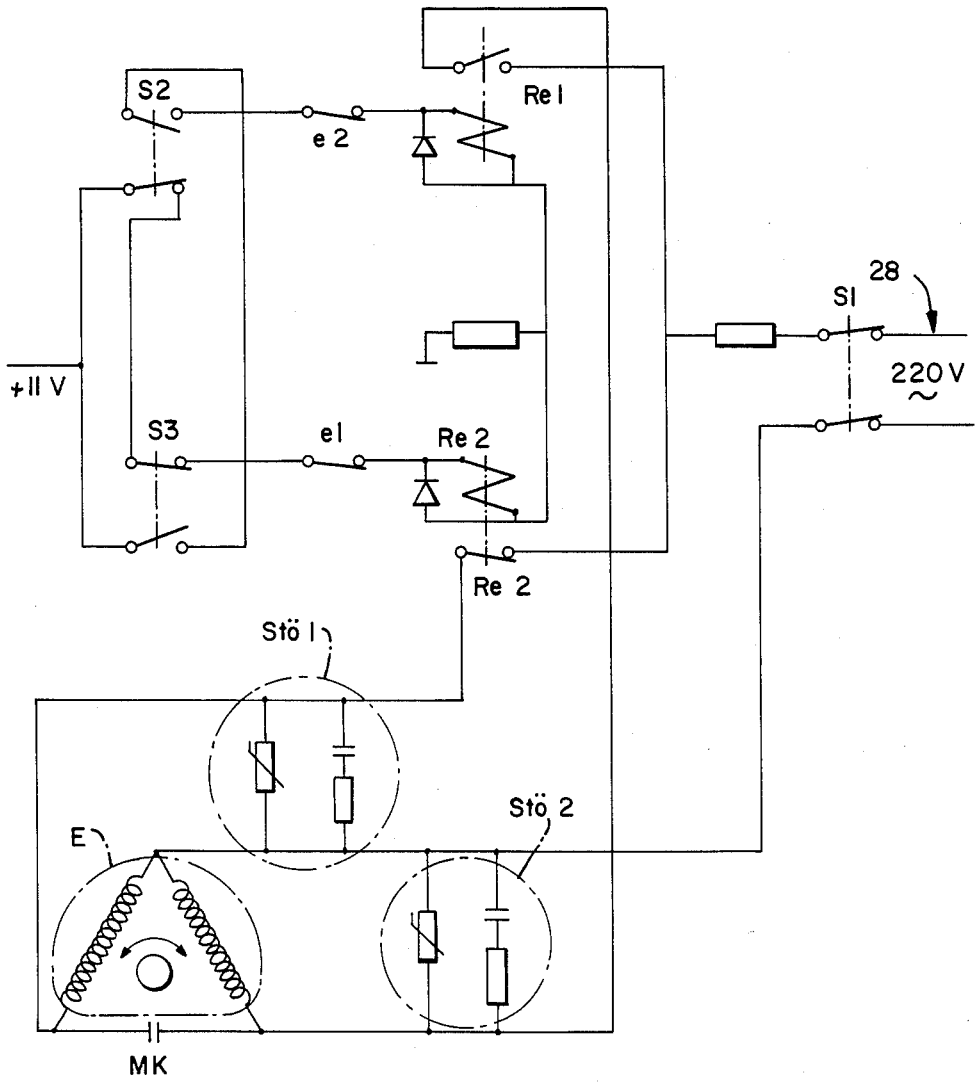
FIG. 7 shows schematically the electrical connection of the electric motor used in the apparatus and the manual actuating and relay devices for controlling the electric motor in both directions.

FIG. 7 shows the basic connection of the electric motor E, its associated condenser MK, the anti-interference circuits St81, St82, and the connections of the manual actuating devices and the relays Re1 and Re2 to the electric motor for control thereof in its two rotary directions. The connection to the electrical power supply is indicated by 28. As far as the remaining designations are concerned, reference is made to the various drawings described above. The manipulation voltage which is used is approximately 11 V. Since the functioning of the motor is known it will not be described in detail here.

The apparatus listed above functions substantially as follows:

The relays R1 and R2 can be controlled by the control devices S2 and S3 and are intended to operate the electric motor E in one direction or the other, according to the operation of the devices. The mutual relationship between the relays, the actuating devices S2 and S3, the limit switches e1 and e2 can be seen in FIG. 7. Switches S2 and S3 are designed so that when they are actuated simultaneously they cause the power supply to the motor to be cut off and to remain cut off for as long as there is simultaneous actuation. The anti-interference devices eliminate interference transients. Furthermore, the control card shown in FIG. 5 is designed to transmit the power supply to the indicating card shown in FIG. 6, preferably consisting of 11 V smoothed direct current. The shaft of the electric motor is designed so that is operates the moveable micro-contact Pk on the potentiometer P. According to the position of the movable contact Pk the potentiometer then supplies various voltages to the digital voltmeter DV. In a preferred embodiment a change of 1 mV in the voltage corresponds to approximately 1 mm change in the height of the desktop above the reference level. The digital voltmeter DV actuates the display unit with its component display elements D', D'' and D''' according to the voltage changes occasioned by the potentiometer. In the proposed system the potentiometer contact Pk will be rotated through approximately 14° before a change of 1 mm occurs on the display unit. The resolution of the reading is ±1 mm. As mentioned above, the digital voltmeter is of a kind which is known and operates on the known "dual slope" principle.

The advantages of the system described above are that a reliable, technically simple system is provided, with few components and high indicating resolution. The construction of the control box may be extremely simple so that it contains relatively few components. The components on the control card may be on a card with printed circuitry which is preferably arranged on one side of the card. As for the indicating card I, this comprises a card with printed circuitry on both sides. Moreover, the proposed apparatus is very insensitive to variations in the power supply. When the voltage of the power supply changes, then the voltage from the potentiometer to the digital voltmeter also changes. However, this does not bring about any changes in the display unit since a reference voltage to the digital voltmeter is changed to a corresponding extent. The quotient between the voltage from the potentiometer and the reference voltage thus always remains constant with respect to changes in the voltage of the power supply. For obvious reasons, however, the supply voltage should not continuously exceed certain limit values, since the electronic circuits require a specific voltage range in order to function. The indication is thus exceptionally insensitive to changes in the voltage of the power supply.

The advantages of the above-described apparatus for a switchboard desk are therefore that the system is simple, inexpensive and operationally reliable. Moreover, the arrangement is exceptionally insensitive to disturbance. Furthermore, in the present embodiment only one electric motor is used.

The invention is not limited to the embodiment shown above by way of example, by may be modified within the framework of the following patent claims.

We claim:

1. An arrangement for adjusting the height of a table, comprising:

a table top and at least two telescopic legs for supporting said table top above a floor;

hydraulic cylinders positioned in each of said telescopic legs for adjusting the length of said telescopic legs, said hydraulic cylinders being connected to at least one hydraulic pump for supplying hydraulic fluid to said hydraulic cylinders said hydraulic pump being driven by a single electric motor;

a first switching device for controlling rotation of said electric motor in a first direction and driving said hydraulic pump in a first direction thereby supplying hydraulic fluid to said hydraulic cylinders for moving said table top downwardly;

a second switching device for controlling rotation of said electric motor in a second direction and driving said hydraulic pump in a second direction thereby supplying hydraulic fluid to said hydraulic cylinders for moving said table top upwardly; said first and second switching devices comprising first and second manual switches connected to first and second relays for supplying electric current for rotating said electric motor in said first and second directions, respectively, and wherein each of said switching device has two contact fingers to disrupt the current supply to said electric motor upon simultaneous activation of both manual switches;

a monitoring device for monitoring the height position of said table top; said monitoring device comprising a potentiometer mounted to a drive shaft of said electric motor, and connected to a voltage source, said potentiometer having slider contact connected to a digital voltmeter for indicating the height position of said table top; and an indication device for indicating of said position.

2. The arrangement as claimed in claim 1, further comprising limit switches connected between said electric motor and said hydraulic pump for disrupting the current supply to said electric motor upon reaching by said table top of a maximum and a minimum height.

3. The arrangement as claimed in claim 1, wherein said potentiometer is connected to said shaft of said electric motor by a helical gear.

4. The arrangement as claimed in claim 1, wherein said slider of said potentiometer is connected to said voltmeter via a scaling device.

5. The arrangement as claimed in claim 4, wherein said scaling device is a voltage divider scaling the output voltage from said potentiometer so that a change of the height position of said table top by 1 mm, corresponding to a rotation of said potentiometer by 14°, results in a change of the voltage to said voltmeter by approximately 1 mV.

6. The arrangement as claimed in claim 1, wherein said voltmeter is provided with a reference voltage which is proportional to a voltage of a power supply, whereby the ratio between the voltage of said slider of said potentiometer and said reference voltage is constant with respect to changes in the voltage of said power supply.

7. The arrangement as claimed in claim 1, wherein said hydraulic pump is a double pump.

* * * * *